US009267508B2

(12) United States Patent
Chang et al.

(10) Patent No.: US 9,267,508 B2
(45) Date of Patent: Feb. 23, 2016

(54) FAN ASSEMBLY

(75) Inventors: Shun-Chen Chang, Taoyuan Hsien (TW); Kuan-Ying Chen, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 686 days.

(21) Appl. No.: 13/609,266

(22) Filed: Sep. 11, 2012

(65) Prior Publication Data

US 2013/0294909 A1 Nov. 7, 2013

(30) Foreign Application Priority Data

May 4, 2012 (TW) ..... 101115878 A

(51) Int. Cl.

| | |
|---|---|
| ***F04D 25/06*** | (2006.01) |
| ***F04D 29/64*** | (2006.01) |
| ***F04D 29/056*** | (2006.01) |
| ***F04D 29/057*** | (2006.01) |

(52) U.S. Cl.

CPC ..... *F04D 25/062* (2013.01); *F04D 29/057* (2013.01); *F04D 29/0563* (2013.01); *F04D 29/646* (2013.01)

(58) Field of Classification Search

CPC ... F04D 25/062; F04D 29/04; F04D 29/0462; F04D 29/05; F04D 29/056; F04D 29/0563; F04D 29/646; F04D 29/668; F04B 35/04

USPC ..... 417/424.1, 424.2

See application file for complete search history.

(56) References Cited

U.S. PATENT DOCUMENTS

| | | | | |
|---|---|---|---|---|
| 5,663,604 | A * | 9/1997 | Takahashi | 310/91 |
| 5,947,704 | A * | 9/1999 | Hsieh | 417/423.12 |
| 6,400,054 | B1 * | 6/2002 | Horng | 310/91 |
| 6,666,652 | B2 | 12/2003 | Bucher et al. | |
| 7,391,140 | B2 * | 6/2008 | Horng et al. | 310/90 |
| 2004/0239198 | A1 | 12/2004 | Horng et al. | |
| 2007/0188034 | A1 * | 8/2007 | Yoshida | 310/90 |
| 2008/0170365 | A1 | 7/2008 | Kuo | |
| 2009/0047148 | A1 * | 2/2009 | Chen et al. | 417/354 |
| 2013/0294909 | A1 * | 11/2013 | Chang et al. | 415/229 |
| 2015/0110649 | A1 * | 4/2015 | Tamaoka et al. | 417/354 |

FOREIGN PATENT DOCUMENTS

| | | | |
|---|---|---|---|
| CN | 101413510 | A | 4/2009 |
| CN | 101929474 | A | 12/2010 |
| TW | 426272 | U | 3/2001 |
| TW | I290790 | B | 12/2007 |
| TW | M330678 | U | 4/2008 |
| TW | I303289 | B | 11/2008 |
| TW | 201033480 | A | 9/2010 |

* cited by examiner

*Primary Examiner* — Ninh H Nguyen
*Assistant Examiner* — Christopher R Legendre
(74) *Attorney, Agent, or Firm* — CKC & Partners Co., Ltd.

(57) ABSTRACT

A fan assembly includes a bushing, a stator, a first bearing, and a rotor. The stator surrounds the bushing, and includes at least one hook. The hook extends into the bushing. The first bearing is disposed in the bushing and presses against the hook. The rotor is pivotally connected to the first bearing.

17 Claims, 8 Drawing Sheets

FAN ASSEMBLY

RELATED APPLICATIONS

This application claims priority to Taiwan Application Serial Number 101115878, filed May 4, 2012, which is herein incorporated by reference.

BACKGROUND

1. Field of Invention

Embodiments of the present invention relate to a fan. More particularly, embodiments of the present invention relate to a fan assembly.

2. Description of Related Art

In order to maintain efficiency and ensure a long life for electronic products such as personal computers, notebook computers, tablet computers, and smart phones, a fan for dissipating heat is used. Such heat-dissipating fans are indispensable for these products.

A fan typically includes a frame and a copper bushing, and the copper bushing is disposed on the center of the frame. A fan also includes a stator, a rotor, a circuit board, and other elements that enable operation of the fan, and these elements are assembled on the copper bushing and fixed in the frame. Because the copper bushing has a high strength and a high heat dissipation ability, it is widely applied in current fans.

In order to prevent the stator from rotating when the rotor is rotating, an adhesive is required between the copper bushing and the stator, so that the stator can be fixed on the copper bushing. However, placing drops of the adhesive between the copper bushing and the stator may increase assembly time and cost. Further, the cost of copper bushings is continuously increasing in line with increases in the cost of copper, placing a higher burden on manufacturers of fans.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one embodiment of the present invention, a fan assembly includes a bushing, a stator, a first bearing, and a rotor. The stator surrounds the bushing, and includes at least one hook. The hook extends into the bushing. The first bearing is disposed in the bushing and presses against the hook. The rotor is pivotally connected to the first bearing.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
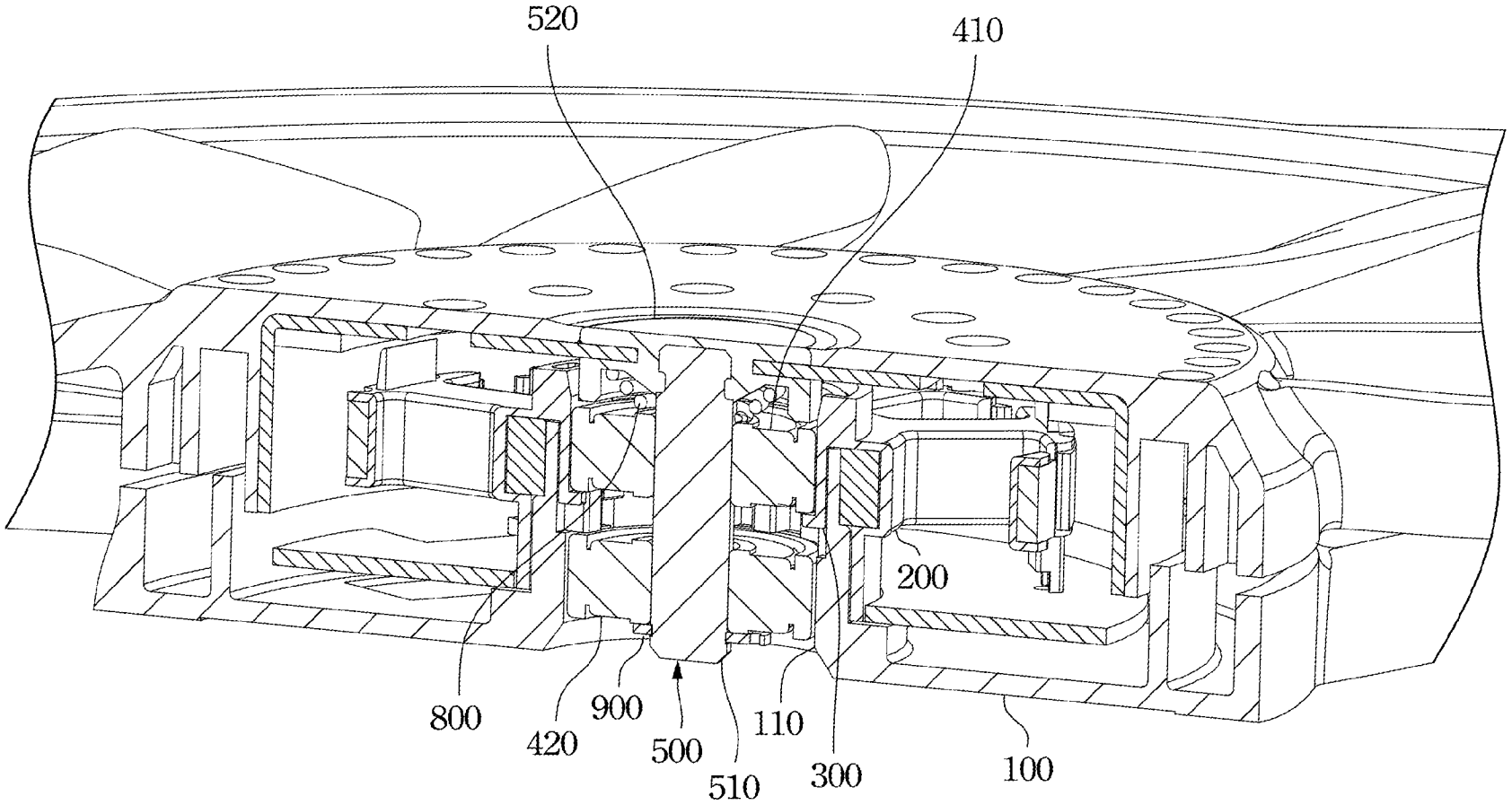
FIG. 1 is a perspective cross-sectional view of a fan assembly in accordance with one embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a perspective cross-sectional view of a fan assembly in accordance with one embodiment of the present invention. As shown in this figure, the fan assembly of the embodiment includes a bushing 110, a stator 200, a first hearing 410, and a rotor 500. The stator 200 surrounds the bushing 110, and includes at least one hook 300. The hook 300 extends into the bushing 110. The first bearing 410 is disposed in the bushing 110 and presses against the hook 300. The rotor 500 is pivotally connected to and contacts the first bearing 410. A part of the rotor 500 which is positioned lower than a second bearing 420 can be fixed in location by a fixing ring 900. When the rotor 500 is in place, it can press against the first bearing 410 and the hook 300 that is connected to the stator 200, so that the stator 200 can be fixed on the bushing 110 without the use of an adhesive.

In this embodiment, the hook 300 can extend into the bushing 110, and the first bearing 410 can press the hook 300, so as to fix the hook 300 and thereby fix the stator 200. Therefore, the stator 200 can be fixed on the bushing 110.

Figure 2:
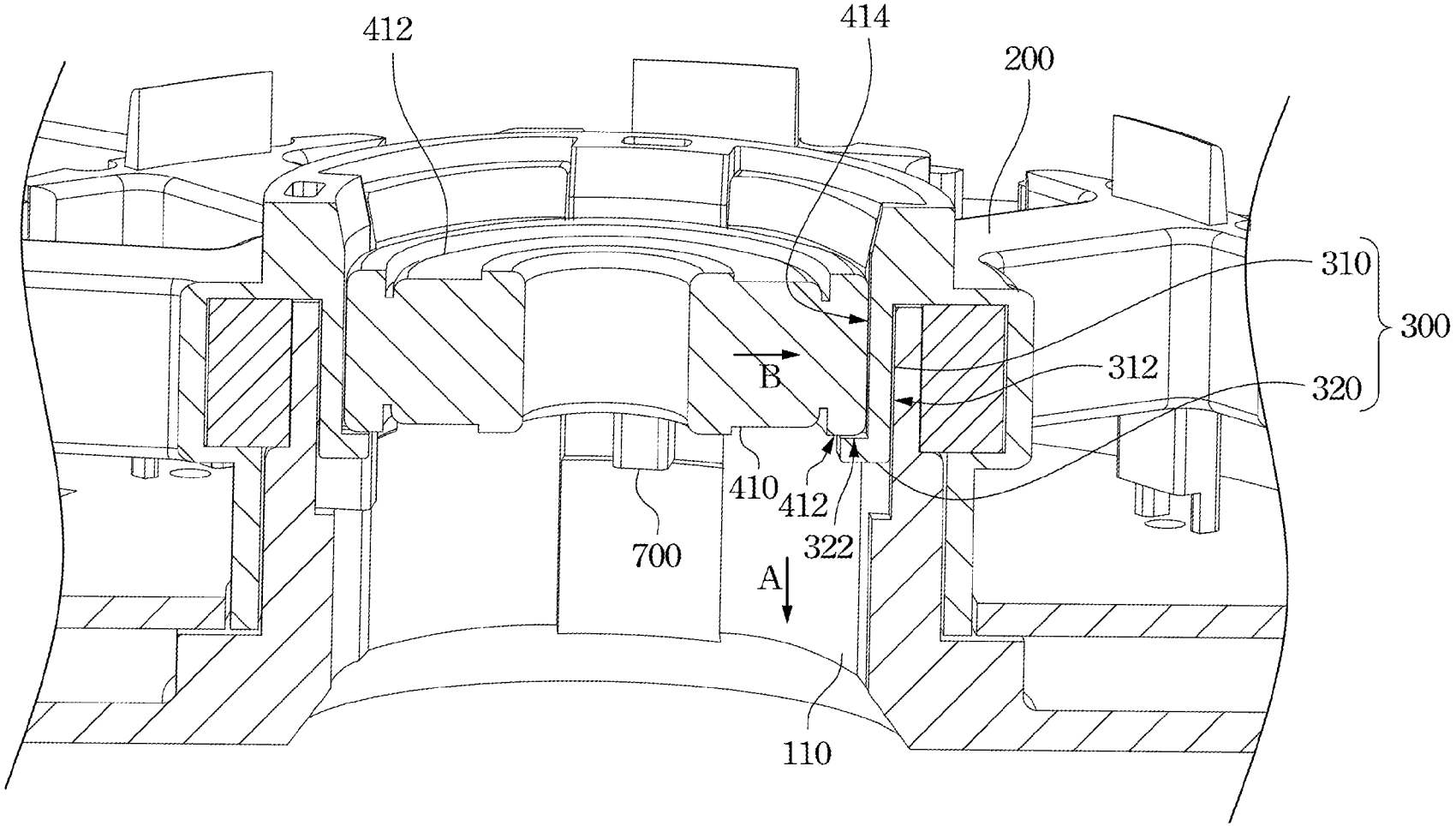
FIG. 2 is a perspective cross-sectional view of the fan assembly in accordance with another embodiment of the present invention.

FIG. 2 is a perspective cross-sectional view of the fan assembly in accordance with another embodiment of the present invention. As shown in this figure, the hook 300 may include a hook arm 310 and a hook protrusion 320. The hook protrusion 320 is protruded at one end of the hook arm 310. The first bearing 410 axially presses against the hook protrusion 320.

It should be noted that "axially" refers to the direction along the axial direction A of the bushing 110. In other words, "axially" as used herein refers to the direction that is parallel to the axis of the bushing 110. In contrast, "radially" refers to the direction along the radial direction B of the bushing 110, that is, the direction that is parallel to the radius of the bushing 110.

The hook protrusion 320 may include at least one radial surface 322 parallel to the radial direction B of the bushing 110. The first bearing 410 may include a bottom surface 412. The bottom surface 412 presses against the radial surface 322. Specifically, the hook arm 310 includes an axial surface 312. The hook protrusion 320 is protruded from the axial surface 312. The axial surface 312 of the hook arm 310 is substantially parallel to the axial direction A. The radial surface 322 of the hook protrusion 320 is parallel to the radial direction B. Therefore, the axial surface 312 of the hook arm 310 and the radial surface 322 of the hook protrusion 320 are substantially perpendicular to each other, so that they can respectively press against the lateral surface 414 and the bottom surface 412 of the first bearing 410. In this embodiment, because the bottom surface 412 of the first bearing 410 presses against the radial surface 322 of the hook protrusion 320, the first bearing 410 can apply a force to the hook protrusion 320 along the axial direction A, thereby preventing the stator 200 from rotating and even being removed from the bushing 110 when the rotor 500 (see FIG. 1) is rotating.

Figure 3:
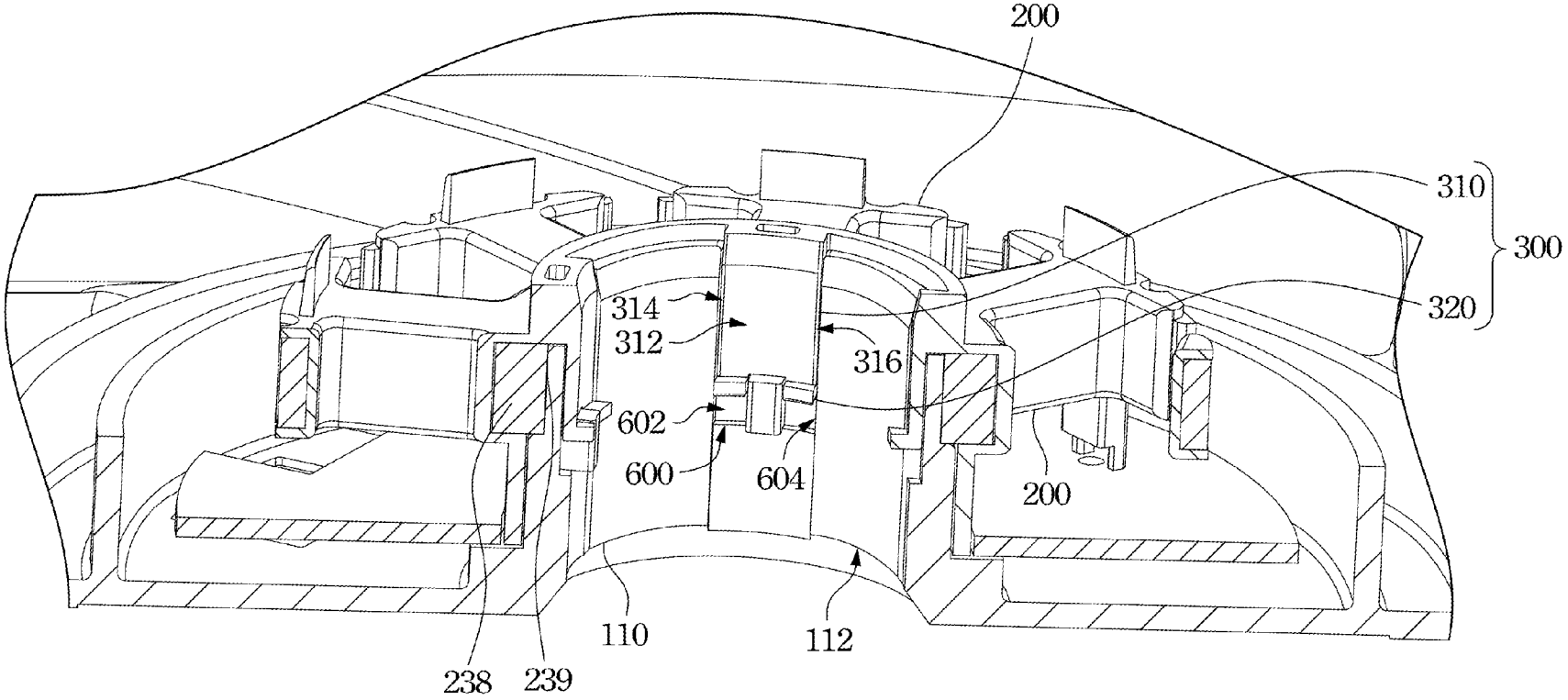
FIG. 3 is a perspective cross-sectional view of the fan assembly in accordance with still another embodiment of the present invention.

FIG. 3 is a perspective cross-sectional view of the fan assembly in accordance with still another embodiment of the present invention. As shown in FIG. 3, the fan assembly of this embodiment may include at least one recess 600, and the bushing 110 may include an inner wall 112. The recess 600 extends inwardly from the inner wall 112 of the bushing 110. The hook 300 is limited by the recess 600, so as to prevent the stator 200 from rotating.

Similar to FIG. 2, the hook 300 of the embodiment may include a hook arm 310 and a hook protrusion 320. The hook arm 310 extends into the recess 600. Specifically, in addition to the axial surface 312, the hook arm 310 may further include a first arm surface 314 and a second arm surface 316. The first arm surface 314 and the second arm surface 316 are respectively formed on opposite sides of the axial surface 312. The recess 600 may include a first lateral wall 602 and a second lateral wall 604. In this embodiment, the first arm surface 314 and the second arm surface 316 of the hook arm 310 respectively contact the first lateral wall 602 and the second lateral wall 604 of the recess 600, so that the hook arm 310 can be limited by the first lateral wall 602 and the second lateral wall 604, and the hook 300 can be prevented from rotating. Therefore, even though the rotor 500 (see FIG. 1) is rotating and applies a torque to the stator 200, the first lateral wall 602 and the second lateral wall 604 can hold the first arm surface 314 and the second arm surface 316 to prevent the stator 200 from rotating.

In this embodiment, the axial surface 312 of the hook arm 310 and the inner wall 112 of the bushing 110 cooperate to form a tube shape, so that the first bearing 410 can be contained therein. Specifically, the curvature of the axial surface 312 and the curvature of the inner wall 112 of the bushing 110 are substantially the same and therefore, a tube-like structure can be formed together by the axial surface 312 and the inner wall 112.

Figure 4:
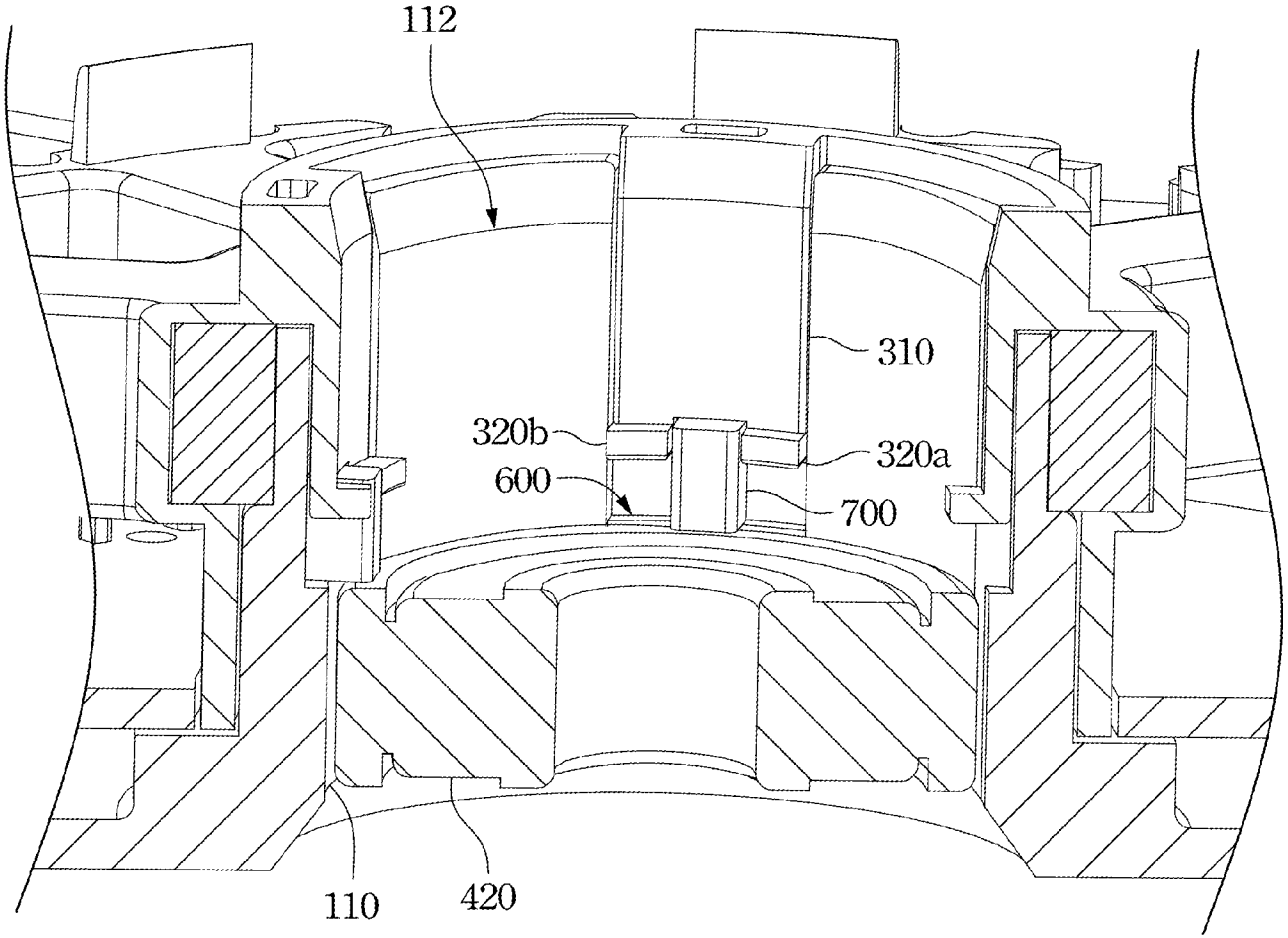
FIG. 4 is a perspective cross-sectional view of the fan assembly in accordance with still another embodiment of the present invention.

FIG. 4 is a perspective cross-sectional view of the fan assembly in accordance with still another embodiment of the present invention. As shown in this figure, the fan assembly of this embodiment may include a second bearing 420 and at least one block 700. The hook 300 extends to a space formed between the first bearing 410 (see FIG. 2) and the second bearing 420. The block 700 is interposed between the first bearing 410 (see FIG. 2) and the second bearing 420. In this embodiment, the second bearing 420 can be limited by the block 700, so that the second bearing 420 cannot be moved axially upwards. Therefore, the second bearing 420 is prevented from colliding with the first bearing 410. In another aspect, the block 700 can also be used to support the first bearing 410, so that the first bearing 410 cannot be moved axially downwards and collide with the second bearing 420.

Similar to FIG. 2, the fan assembly of this embodiment may include at least one recess 600, and the block 700 is protruded in the recess 600.

In this embodiment, the hook 300 includes a hook arm 310, a first hook protrusion 320*a*, and a second hook protrusion 320*b*. The hook arm 310 extends into the recess 600. The first hook protrusion 320*a* and the second hook protrusion 320*b* respectively abut against opposite sides of the block 700. The first bearing 410 axially presses against the first hook protrusion 320*a* and the second hook protrusion 320*b*, as will be described below.

Figure 5:
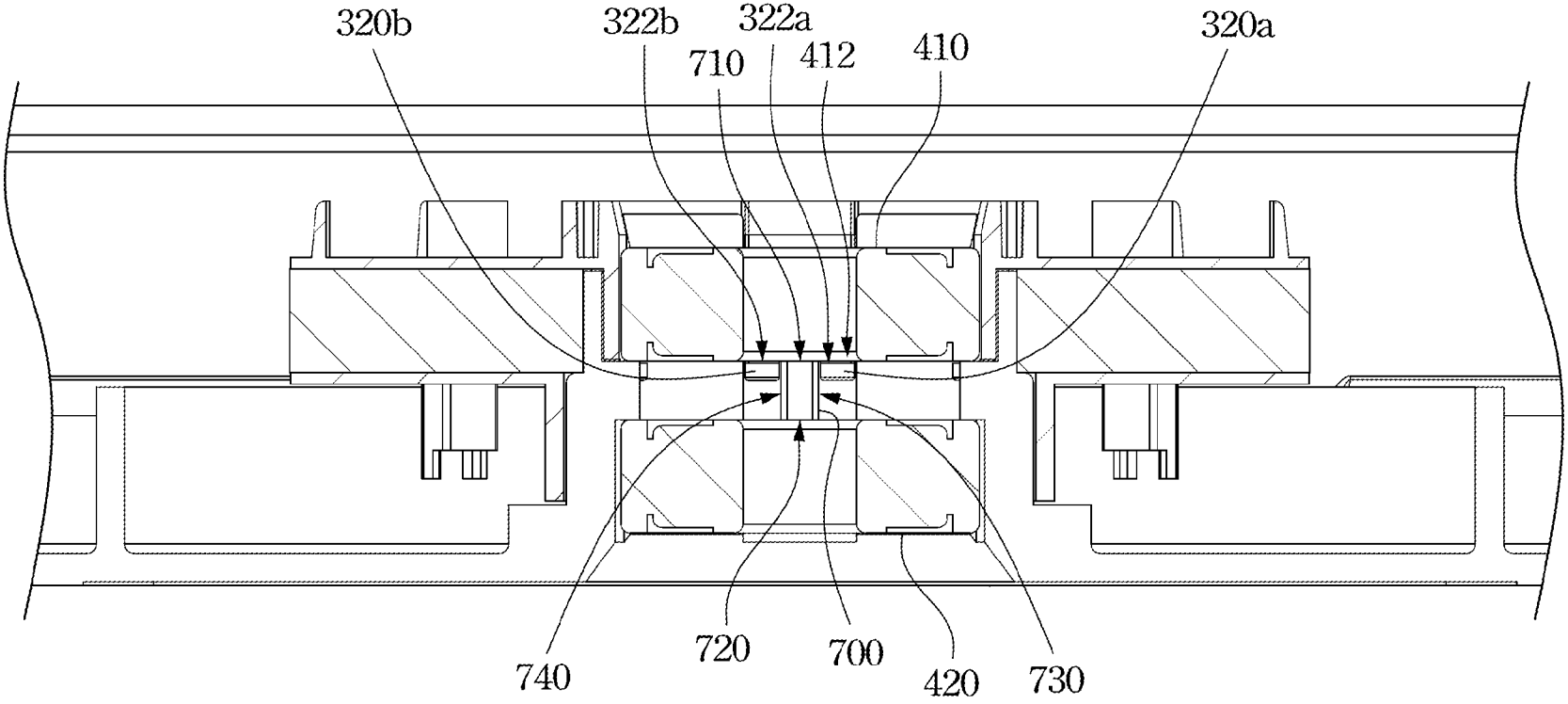
FIG. 5 is a cross-sectional view of the fan assembly of FIG. 4, illustrating the fan assembly with a first bearing and a second bearing mounted therein.

Specifically, FIG. 5 is a cross-sectional view of the fan assembly of FIG. 4, illustrating the fan assembly in a state with the first bearing 410 and the second bearing 420 mounted therein. As shown in FIG. 5, the block 700 may include a first lateral surface 730 and a second lateral surface 740. The first hook protrusion 320*a* contacts the first lateral surface 730 of the block 700. The second hook protrusion 320*b* contacts the second lateral surface 740 of the block 700.

In this embodiment, the first hook protrusion 320*a*, the second hook protrusion 320*b* and the block 700 may support the first bearing 410 together. Specifically, the first hook protrusion 320*a* and the second hook protrusion 320*b* may respectively include a first radial surface 322*a* and a second radial surface 322*b*. The block 700 may include a first end surface 710 and a second end surface 720, and each of the first end surface 710 and the second end surface 720 is adjacent to the first lateral surface 730 and the second lateral surface 740. The first end surface 710, the first radial surface 322*a* and the second radial surface 322*b* contact the bottom surface 412 of the first bearing 410 together, so that the first bearing 410 can be supported. In some embodiments, the first end surface 710, the first radial surface 322*a* and the second radial surface 322*b* have the same height, such that they can contact the bottom surface 412 of the first bearing 410 together.

Figure 6:
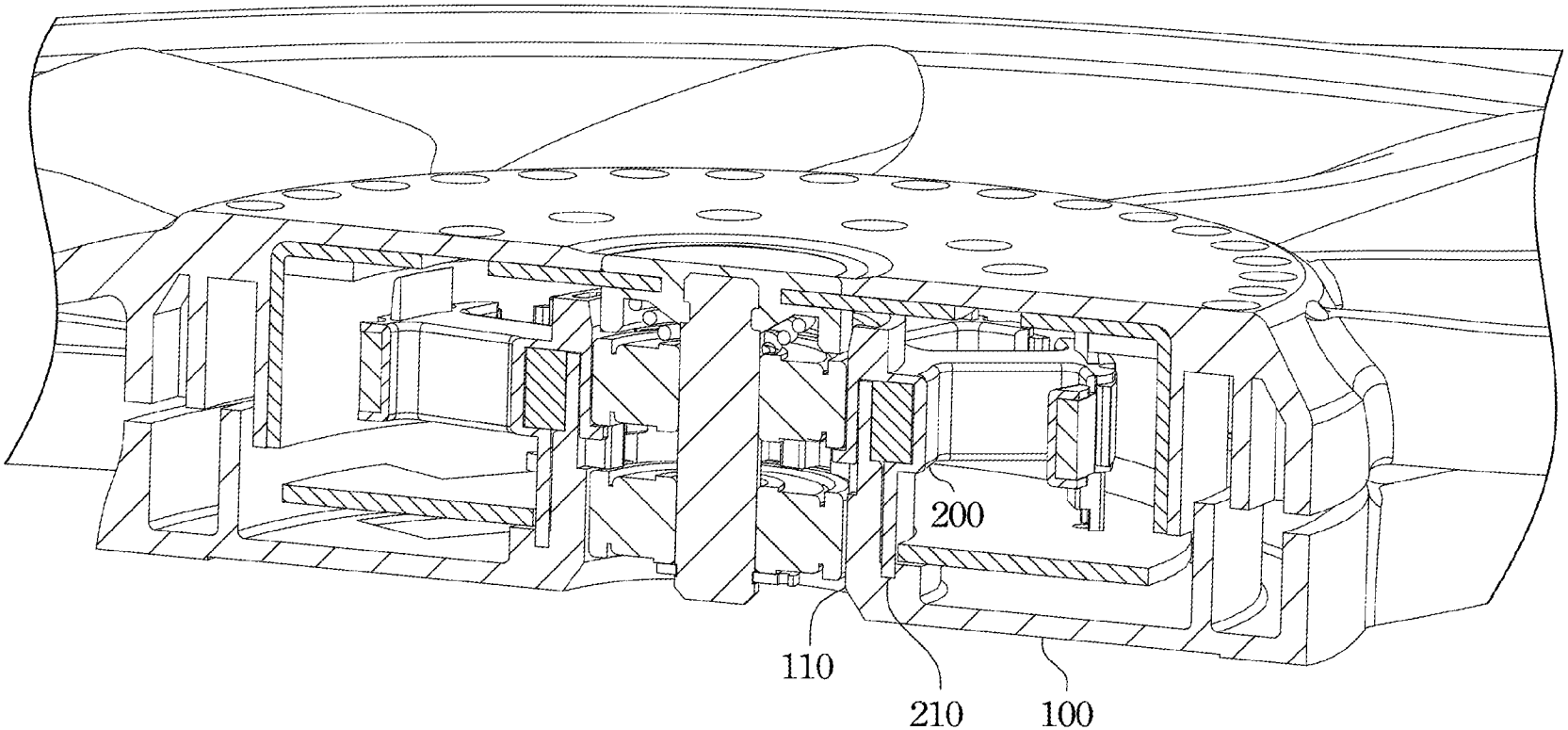
FIG. 6 is a perspective cross-sectional view of the fan assembly in accordance with still another embodiment of the present invention.

FIG. 6 is a perspective cross-sectional view of the fan assembly in accordance with still another embodiment of the present invention. The fan assembly of this embodiment may include a fan base 100. The fan base 100 surrounds the bushing 110. The fan base 100 and the bushing 110 can be formed together by injection molding, and they can be used as a frame of the fan assembly. In this embodiment, because the fan base 100 and the bushing 110 can be formed together through a process of injection molding, there is no need to dispose a copper bushing in the fan base 100.

In this embodiment, the stator 200 includes at least one pin 210. The pin 210 inserts into the fan base 100. In some embodiments, the stator 200 may include a plurality of pins 210 inserted into the fan base 100 in a spaced-apart manner. The pin 210 or pins 210 can be fixed in the fan base 100 and can prevent the stator 200 from rotating, so that the stability of the stator 200 can be further promoted.

Figure 7:
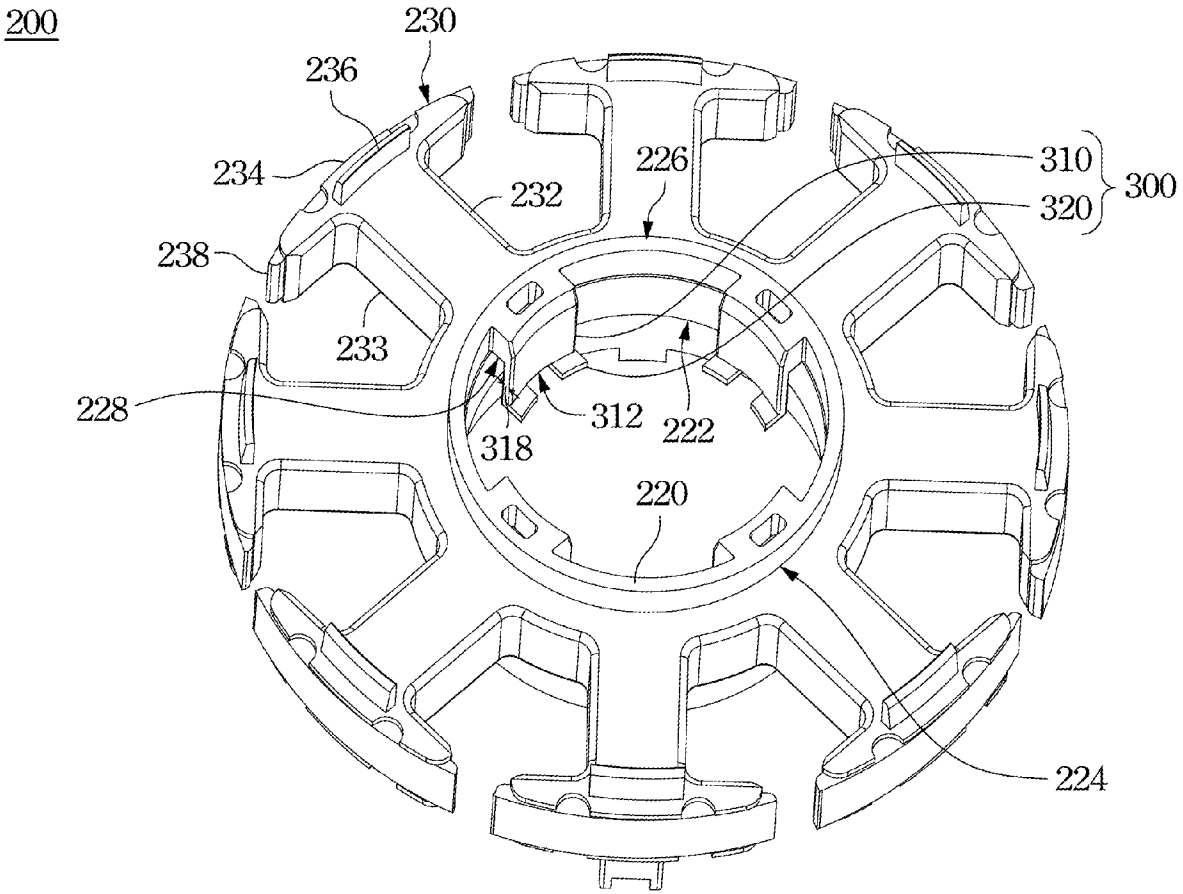
FIG. 7 is a perspective view of a stator in accordance with one embodiment of the present invention.

FIG. 7 is a perspective view of the stator 200 in accordance with one embodiment of the present invention. As shown in FIG. 7, the stator 200 may include a ring 220 and a plurality of magnetic structures 230. The ring 220 includes an inner surface 222 and an outer surface 224. The hook 300 is connected to the inner surface 222 of the ring 220. The magnetic structures 230 are connected to the outer surface 224 of the ring 220, extend radially from the outer surface 224, and are separated from each other. The ring 220 is higher than the magnetic structures 230.

Specifically, the ring 220 includes a top surface 226. The height of top surface 226 is higher than the heights of the magnetic structures 230. Therefore, the top surface 226 can protect the magnetic structures 230 and can prevent the rotor 500 (see FIG. 1) from contacting or rubbing against the magnetic structures 230.

In some embodiments, the ring 220 may include an extending part 228. The extending part 228 is extended from the inner surface 222 to the hook arm 310 of the hook 300. When the stator 200 is assembled with the hushing 110 (see FIG. 1), the bushing 110 can support the extending part 228, so as to prevent the stator 200 from moving axially downwards.

In some embodiments, each of the magnetic structures 230 includes a shell 233 and a magnetic body 238. Part of the magnetic body 238 is covered in the shell 233. Specifically, the shell 233 may include a winding part 232, an arc-shaped part 234 and a wall 236. The winding part 232 is used to wind a coil (not shown) therearound, so as to generate a magnetic force with the magnetic body 238. The height of the wall 236 is higher than that of the winding part 232, so as to prevent the coil on the winding part 232 from contacting or rubbing against the rotor 500. The arc-shaped part 234 is connected to one end of the winding part 232 that is opposite to the ring 220. In some embodiments, the arc-shaped parts 234 of the magnetic structures 230 have the same curvature, so as to form a circle. In some embodiments, the magnetic body 238 may include, but is not limited to including, silicon steel. The shell 233 can be made of insulated material, so as to insulate the magnetic body 238 from the coil on the winding part 232. As shown in FIG. 3, the magnetic body 238 has an inner circumferential surface 239. The inner circumferential surface 239 faces toward and is spatially separated from a portion of the hook 300. Two opposite sides of a portion of inner wall 112, which is an annular wall, is sandwiched between the portion of the hook 300 and the inner circumferential surface 239.

Figure 8:
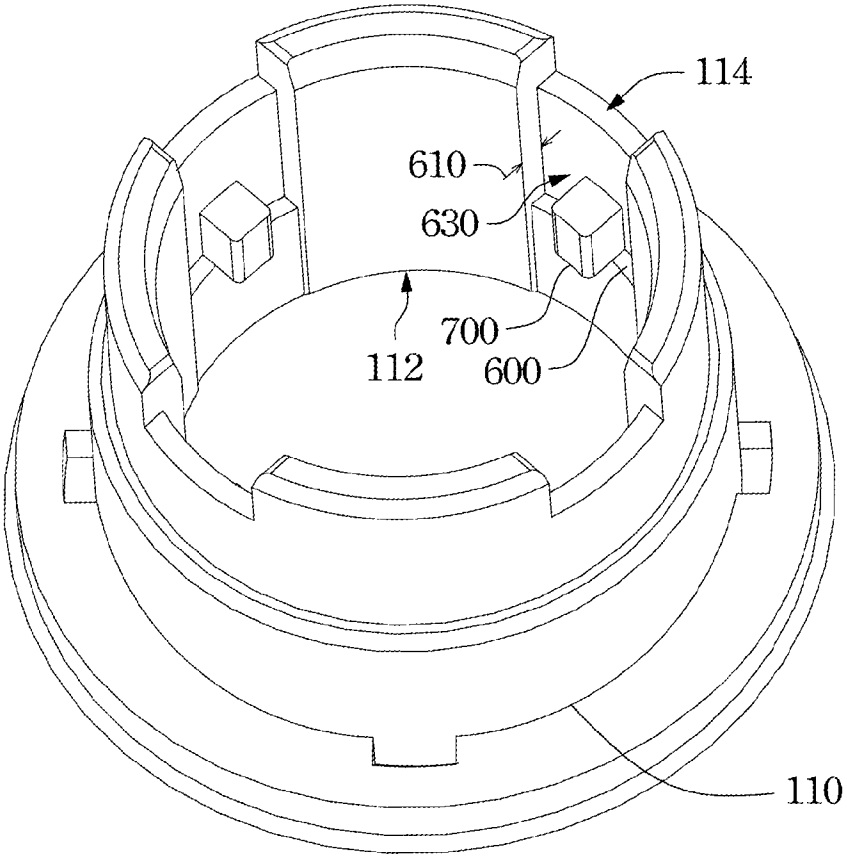
FIG. 8 is a perspective view of a bushing in accordance with one embodiment of the present invention.

FIG. 8 is a perspective view of the bushing 110 in accordance with one embodiment of the present invention. As shown in FIG. 8, the recess 600 extends inwardly from the inner wall 112 of the bushing 110. Specifically, the recess 600 includes a back wall 630. The inner wall 112 and the back wall 630 are spaced apart by a distance 610, so that the recess 600 can be formed in a concave configuration and consequently can limit the position of the hook arm 310 (see FIG. 7), thereby preventing the stator 200 from rotating.

In some embodiments, the hook arm 310 includes a thickness 318 (see FIG. 7). The thickness 318 and the distance 610 are substantially the same, so that the axial surface 312 (see FIG. 7) of the hook arm 310 and the inner wall 112 of the bushing 110 can form a smooth ring together.

In some embodiments, the bushing 110 includes a supporting part 114. The supporting part 114 is used to support the extending part 228 of the stator 200 (see FIG. 7). In other words, when the stator 200 is assembled on the bushing 110, the extending part 228 of the stator 200 is supported by the supporting part 114 of the bushing 110, so as to prevent the stator 200 from moving axially downwards. Specifically, the supporting part 114 of the bushing 110 and the extending part 228 of the stator 200 are similar in shape and size, so that the supporting part 114 can support the extending part 228.

Referring hack to FIG. 1, in some embodiments, the rotor 500 may include a shaft 510 and a wheel hub 520. The shaft 510 axially passes through the first bearing 410. The wheel hub 520 is connected to one end of the shaft 510.

In some embodiments, the fan assembly may include a spring 800. The rotor 500 presses against the spring 800, so that the spring 800, in turn, presses against the first bearing 410. Specifically, the wheel hub 520 of the rotor 500 presses against the spring 800, so as to provide an axial force to the first bearing 410 via the spring 800, thereby ensuring that the first bearing 410 presses against the hook 300.

In some embodiments, the shaft 510 passes through the second bearing 420. The fan assembly may include the fixing ring 900, as described above. The fixing ring 900 is connected to the shaft 510 and is disposed on a surface of the second bearing 420 that is opposite to the first bearing 410 to thereby secure the positioning of the second bearing 420. In some embodiments, the fixing ring 900 may include, but is not limited to including, a C-shaped buckle.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A fan assembly, comprising:

a bushing having an annular wall defining a cylindrical space therein;

a stator surrounding the bushing, the stator comprising a magnetic body and at least one hook, wherein the magnetic body comprises an inner circumferential surface facing toward and spatially separated from a portion of the hook, wherein the hook extends into the cylindrical space, wherein two opposite sides of a portion of the annular wall of the bushing are sandwiched between the portion of the hook and the inner circumferential surface;

a first bearing disposed in the cylindrical space and pressing against the hook; and a rotor pivotally connected to the first bearing.

2. The fan assembly of claim 1, wherein the hook comprises:

a hook arm; and a hook protrusion protruded at one end of the hook arm, the first bearing axially pressing against the hook protrusion.

3. The fan assembly of claim 2, wherein the hook protrusion comprises at least one radial surface parallel to a radial direction of the bushing, wherein the first bearing comprises a bottom surface, and the bottom surface presses against the radial surface.

4. The fan assembly of claim 1, further comprising:

at least one recess, wherein the bushing comprises an inner wall, and the recess extends inwardly from the inner wall, and the hook is limited by the recess to thereby prevent the stator from rotating.

5. The fan assembly of claim 4, wherein the hook comprises:

a hook arm extending into the recess; and a hook protrusion protruded at one end of the hook arm.

6. The fan assembly of claim 5, wherein the recess comprises at least one lateral wall, and the hook arm comprises at least one arm surface, wherein the arm surface contacts the lateral wall.

7. The fan assembly of claim 5, wherein the hook arm comprises an axial surface, and the axial surface and the inner wall of the bushing cooperate to form a tube shape.

8. The fan assembly of claim 1, further comprising:

a second bearing, the hook extending to a space formed between the first bearing and the second bearing; and at least one block interposed between the first bearing and the second bearing.

9. The fan assembly of claim 8, further comprising:

at least one recess, wherein the bushing comprises an inner wall, and the recess extends inwardly from the inner wall, wherein the block is protruded from the recess.

10. The fan assembly of claim 9, wherein the hook comprises:

a hook arm extending into the recess;

a first hook protrusion; and a second hook protrusion, the first hook protrusion and the second hook protrusion respectively abutting against opposite sides of the block, the first bearing axially pressing against the first hook protrusion and the second hook protrusion.

11. The fan assembly of claim 10, wherein the first hook protrusion, the second hook protrusion, and the block support the first bearing together.

12. The fan assembly of claim 1, further comprising:

a fan base surrounding the bushing, wherein the fan base and the bushing are formed together by injection molding.

13. The fan assembly of claim 12, wherein the stator comprises at least one pin inserting into the fan base.

14. The fan assembly of claim 1, wherein the stator comprises:

a ring having an inner surface and an outer surface, the hook being connected to the inner surface of the ring;

a plurality of magnetic structures connected to and extending radially from the outer surface of the ring and separated from each other, the ring being higher than the magnetic structures.

15. The fan assembly of claim 1, wherein the rotor comprises:

a shaft axially passing through the first bearing; and a wheel hub connected to one end of the shaft.

16. The fan assembly of claim 15, further comprising:

a second bearing, the shaft passing through the second bearing; and a fixing ring positioning the shaft and disposed on a surface of the second bearing that is opposite to the first bearing.

17. The fan assembly of claim 1, further comprising:

a spring, the rotor pressing against the spring, and the spring in turn pressing against the first bearing.

* * * * *